United States Patent [19]

McEwan et al.

[11] 4,056,386

[45] Nov. 1, 1977

[54] METHOD FOR DECOMPOSING IRON PENTACARBONYL

[75] Inventors: William S. McEwan, Ridgecrest, Calif.; Hans B. Jonassen, New Orleans, La.

[73] Assignee: The United States of America as represented by the Secretary of the Navy, Washington, D.C.

[21] Appl. No.: 788,726

[22] Filed: Apr. 19, 1977

[51] Int. Cl.[2] ..... C21B 15/04

[52] U.S. Cl. ..... 75/0.5 BA; 75/28; 423/417

[58] Field of Search ..... 75/28, 29, 33, .5 BA; 423/417; 164/DIG. 1

[56] References Cited

U.S. PATENT DOCUMENTS

| | | | |
|---|---|---|---|
| 1,789,813 | 1/1931 | Gaus | 423/417 |
| 3,079,235 | 2/1963 | Dakli et al. | 423/417 |
| 3,728,104 | 4/1973 | Coffield | 423/417 X |
| 3,767,378 | 10/1973 | Cochran et al. | 423/417 |
| 3,966,886 | 12/1971 | Bakker | 75/.5 BA |

OTHER PUBLICATIONS

Johnson et al., *Fuels & Combustion Handbook,* 1951, McGraw-Hill Co., TP318J6, pp. 306 & 307.

*Primary Examiner*—M. J. Andrews

*Attorney, Agent, or Firm*—R. S. Sciascia; Roy Miller; Lloyd E. K. Pohl

[57] ABSTRACT

A homogeneous gaseous catalyst such as $H_2$, NO, $PF_3$, $PH_3$, $NH_3$ or a halogen is used to speed the decomposition of gaseous iron pentacarbonyl into solid iron and gaseous carbon monoxide.

4 Claims, No Drawings

METHOD FOR DECOMPOSING IRON PENTACARBONYL

BACKGROUND OF THE INVENTION

1. Field of the Invention

This invention relates to a process for decomposing gaseous iron pentacarbonyl into solid iron and gaseous carbon monoxide. More specifically, this invention relates to a process for decomposing gaseous iron pentacarbonyl involving the step of contacting the pentacarbonyl with a homogeneous gaseous catalyst.

2. Description of the Prior Art

When iron pentacarbonyl is decomposed into free iron and carbon monoxide, the resulting iron is of very high purity. Because of the high purity, the iron is in demand for use wherever very pure iron is needed.

The fact that iron pentacarbonyl can be decomposed into iron and carbon monoxide is taught in U.S. Pat. No. 1,789,813 which issued to Wilhelm Gaus in 1931. Gaus removes iron from ores by reducing the iron oxide present in the ore to iron with hydrogen or the like, reacting the iron with carbon monoxide at high temperatures and under high pressures to form iron pentacarbonyl and then decomposing the pentacarbonyl by subjecting it to a temperature of about 200° C or more.

U.S. Pat. No. 3,767,378 which issued to Andrew A. Cochran et al. in 1973 indicates that reduced pressure used alone or in combination with temperatures of from about 280° to about 350° C will bring about decomposition of iron pentacarbonyl. More specifically, Cochran et al. describe a process whereby an ore which contains iron oxide is subjected to a reducing agent such as hydrogen to reduce the oxide to iron, the iron is treated with carbon monoxide in the presence of ammonium sulfide to produce iron pentacarbonyl and the iron pentacarbonyl is decomposed to iron and carbon monoxide by means of reduced pressure alone or in combination with heat. The ammonium sulfide acts as a catalyst to speed the reaction of the iron and carbon monoxide to form iron pentacarbonyl.

In addition to disclosing the usefulness of ammonium sulfide as a catalyst in the formation of iron pentacarbonyl, Cochran et al. discuss experiments in which they attempted to use ammonia as a formation catalyst. They found that ammonia was helpful but not very helpful in the promotion of the formation of the carbonyl.

Despite the fact that iron pentacarbonyl will decompose into iron and carbon monoxide at the temperatures mentioned by Gaus (200° C +) and Cochran et al. (280° to 350° C), the decomposition is rather slow. Cochran et al., for example, disclose that a "longer residence time" is desirable. In other words, in their process wherein carbon monoxide is passed over iron to form the pentacarbonyl and the pentacarbonyl is subsequently decomposed, the flow of gas in the decomposition zone must be slower than that in the formation zone. Since it is desirable to recycle the carbon monoxide produced during the decomposition stage, it would be advantageous if the decomposition state could be speeded up. That is, it would be advantageous if decomposition could be made to occur at about the same rate as formation.

SUMMARY OF THE INVENTION

It has now been found that ammonia, rather than promoting the formation of iron pentacarbonyl as taught by Cochran et al. actually is a useful catalyst in promoting the decomposition of iron pentacarbonyl. Additionally, it has been found that several other compounds are useful in promoting the decomposition of iron pentacarbonyl. Included among these compounds are $H_2$, NO, $PF_3$, $PH_3$and halogens such as $I_2$. According to this invention, the rate of decomposition of gaseous iron pentacarbonyl into iron and carbon monoxide at any given temperature (such as the 200° C taught by Gaus or 280° to about 350° C taught by Cochran et al.) is increased about five to seven fold by utilizing one of the above-named compounds as a catalyst.

DESCRIPTION OF THE PREFERRED EMBODIMENT

This invention involves the contacting of iron pentacarbonyl with a gaseous homogeneous catalyst selected from the group consisting of $H_2$, NO, $PF_3$, $PH_3$, $NH_3$and halogen to speed the decomposition thereof.

Insofar as the source of the pentacarbonyl is concerned, a formation process such as that taught either by Gaus or by Cochran et al. may be used. Or, liquid iron pentacarbonyl, which is abundant, readily obtainable material, may be converted to gaseous iron pentacarbonyl by means of elevated temperatures.

Whatever the source of gaseous iron pentacarbonyl, it is naturally preferable that the zone or place where the decomposition is to occur be free of oxygen. If it is not, the newly formed iron will quickly oxidize to iron oxide. For this reason, a closed system from which the oxygen has been removed and replaced with an inert gas such as nitrogen may be used.

EXAMPLE 1

To practice this invention using liquid iron pentacarbonyl as the source from which gaseous iron pentacarbonyl is to come, the following steps may be utilized. First, a container of liquid iron pentacarbonyl and a source from which a mixture of an inert gas such as nitrogen and one of the catalyst gases may be obtained are connected to a reaction chamber. Next, the reaction chamber is evacuated to remove air and the air is replaced with the inert gas-catalytic gas mixture. Then the iron pentacarbonyl container is opened to the reaction chamber and gaseous iron pentacarbonyl is produced by heating the iron pentacarbonyl to its boiling point. When the gaseous iron pentacarbonyl and inert gas-catalystic gas mixture come into contact with one another, decomposition of the iron pentacarbonyl occurs at a very rapid rate. Experiments with the above-named gases have shown that the decomposition rate is increased on the order of from five to seven fold over that achieved at any given temperature when no catalyst gas is used.

EXAMPLE 2

The process of this invention may also be practiced using the iron pentacarbonyl forming steps taught by Cochran et al. Once formed, the decomposition to very pure iron and carbon monoxide may be carried out by contacting the pentacarbonyl with a nitrogen-catalytic gas mixture as taught herein at the temperatures taught by Cochran et al. or lower temperatures as taught by Gaus.

As pointed out above, the temperature used is not critical. That is, iron pentacarbonyl may be heated to any temperature at which decomposition would normally take place and the utilization of any one of the above-named catalytic gases will increase the rate of decomposition about five fold over the rate of decomposition were no catalytic gas present.

In efforts to deterine the optimum ratio of catalytic gas to nitrogen, several experiments were run. The experiments consisted of evaporating 50 ml. of $Fe(CO)_5$ into a 186 ml. flask which contained a mixture of $N_2$ and catalytic gas at approximately 200° to 205° C and measuring the time required for complete decomposition. Typical of the results are results obtained when $H_2$ was used as the catalytic gas and the total pressure of the $N_2$ — $H_2$ gaseous mixture in the flask was 300 torr. It was found that it made very little difference when the partial pressure of $H_2$ was varied between 2 torr. and 10 torr. This is, when 2 parts of the total pressure of 300 torr were provided by hydrogen and 298 by nitrogen the results were very similar to the case where 10 parts of the pressure were provided by hydrogen and 290 by nitrogen. In either case and in cases in between (Example: 5 torr. $H_2$ and 295 ton $N_2$), decomposition of the iron pentacarbonyl was essentially complete within about 3 seconds. The lower amount (2 torr.) of hydrogen appeared to produce slightly although not significantly faster results. From this, it readily follows that, if one desired, even greater amounts of catalytic gas could be used but that the use of greater amounts would provide no advantages. That is, if one desired, 100% catalytic gas could be used in lieu of the nitrogen-catalytic gas mixture but no advantage would be obtained.

By contrast, when experiments similar to those described in the immediately preceding paragraph were run with only $N_2$ as the gas in the flask, total decomposition required 20 seconds rather than the 3 required when $H_2$ was present.

It should be pointed out here that if extremely pure iron is desired it may be preferable to use either $H_2$ or $NH_3$ as the catalytic gas. The other above-named gases may tend to react with the iron after it is produced.

The experiments were carried out using nitrogen-catalytic gas mixtures. It will be apparent to those skilled in the art that other inert gases such as helium, argon, etc. could be used in lieu of nitrogen.

What is claimed is:

1. In a method for producing iron comprising the steps of providing iron pentacarbonyl and subjecting the iron pentacarbonyl to an elevated temperature to cause it to decompose into iron and carbon monoxide the improvement residing in utilizing as a catalyst to speed the rate of decomposition, a gas selected from the group consisting of $H_2$, NO, $PF_3$, $PH_3$, $NH_3$ and $I_2$.

2. A method according to claim 1 wherein the gas selected is $H_2$.

3. A method according to claim 2 wherein the $H_2$ is mixed with $N_2$.

4. A method according to claim 3 wherein from 2 parts of $H_2$ per 298 parts of $N_2$ to 10 parts of $H_2$ per 290 parts of $N_2$ are used.

* * * * *